US006183931B1

(12) United States Patent
Odell

(10) Patent No.: US 6,183,931 B1
(45) Date of Patent: Feb. 6, 2001

(54) LIQUID DEVELOPER PROCESSES

(75) Inventor: Peter G. Odell, Mississauga (CA)

(73) Assignee: Xerox Corporation, Stamford, CT (US)

( * ) Notice: Under 35 U.S.C. 154(b), the term of this patent shall be extended for 0 days.

(21) Appl. No.: 08/315,005

(22) Filed: Sep. 29, 1994

(51) Int. Cl.[7] ..... G03G 9/12
(52) U.S. Cl. ..... 430/137; 430/112; 430/114
(58) Field of Search ..... 430/137, 112, 430/114, 115; 526/941

(56) References Cited

U.S. PATENT DOCUMENTS

| | | | | |
|---|---|---|---|---|
| 3,969,196 | * | 7/1976 | Zosel | 203/49 |
| 4,923,778 | | 5/1990 | Blair et al. | 430/137 |
| 5,017,451 | | 5/1991 | Larson et al. | 430/137 |
| 5,030,535 | | 7/1991 | Drappel et al. | 430/116 |
| 5,206,108 | | 4/1993 | Felder et al. | 430/137 |
| 5,254,427 | * | 10/1993 | Lane et al. | 430/114 |

OTHER PUBLICATIONS

Weast, R.C. et al. Eds. CRC Handbook of Chemistry and Physics, 62nd Edition, (1981–1982) p. F–76.*

* cited by examiner

*Primary Examiner*—Janis L. Dote
(74) *Attorney, Agent, or Firm*—E. O. Palazzo

(57) ABSTRACT

A process for the preparation of a liquid developer comprised of thermoplastic resin particles, pigment, a charge additive or adjuvant, and a charge director, which process comprises a supercritical solvent extraction to enable a developer with a high solids content.

19 Claims, 1 Drawing Sheet

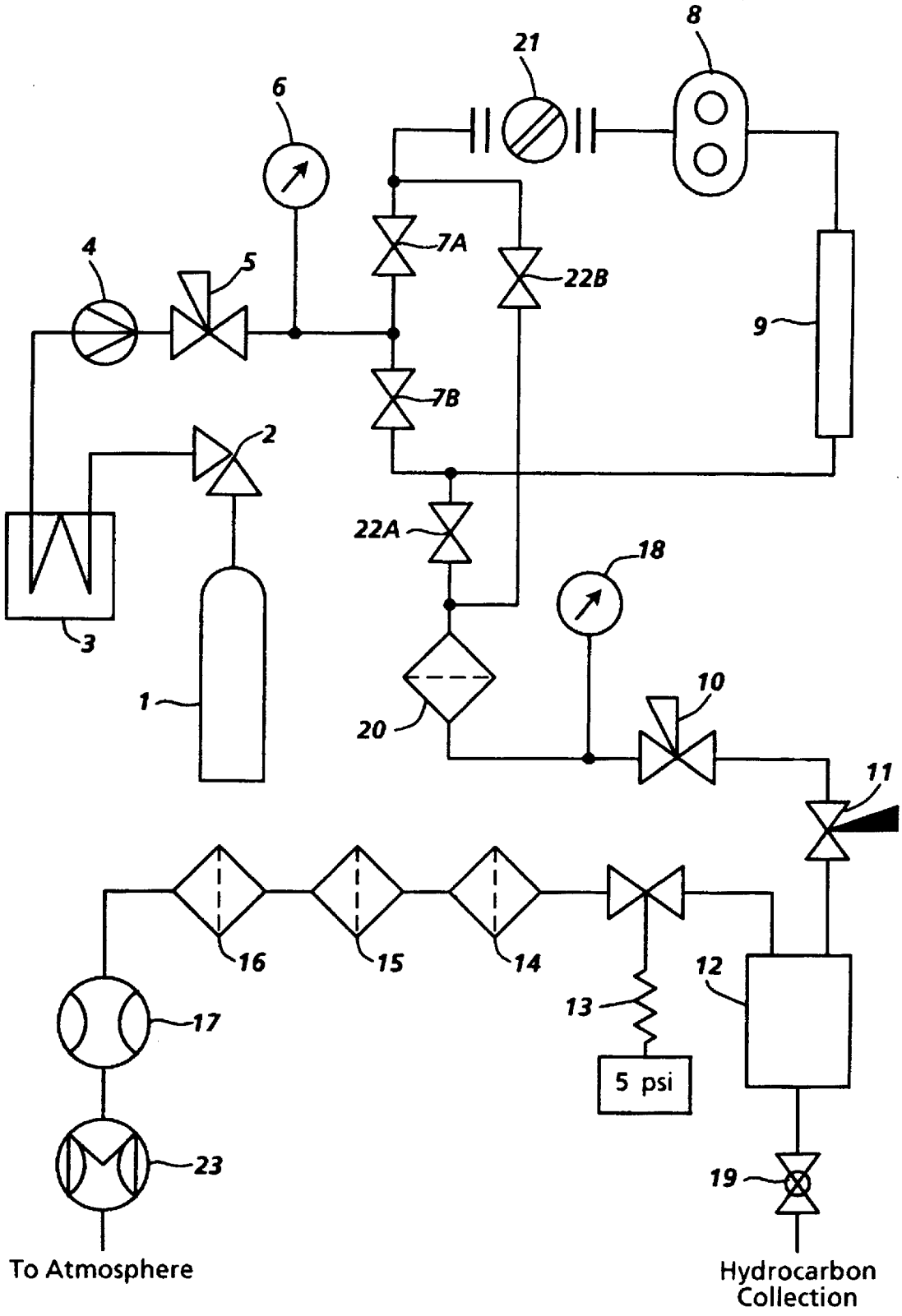
8
21
6
7A
22B
4
5
9
7B
2
22A
18
3
1
20
10
11
16
15
14
12
13
17
5 psi
23
19
To Atmosphere
Hydrocarbon Collection

LIQUID DEVELOPER PROCESSES

BACKGROUND OF THE INVENTION

This invention is generally directed to liquid developer compositions and, more specifically, the present invention relates to processes for the preparation of a liquid developer containing, for example, NORPAR® with supercritical fluid extraction. In embodiments, the present invention relates to processes for the preparation of liquid developers with high solids contents of, for example, about equal to or greater than 50 weight percent. The process of the present invention in embodiments comprises the extraction from the developer of the ink vehicle like NORPAR® by relatively mild supercritical extraction, and more specifically supercritical carbon dioxide solvent extraction to thereby concentrate the liquid ink solids of resin, pigment, and charge adjuvant or charge additive. The process of the present invention can be selected to fabricate liquid ink concentrates that can then be selected for electrographic, especially xerographic, systems wherein liquid hydrocarbons are recycled. Advantages of using high solids ink replenishment processes include avoiding the build up of excess liquid carrier by replenishing the developer housing with a percent solid ink that is equal to the percentage solid concentration of the image fixed to the paper, typically about 50 percent, and greater stability with respect to storage of the high solids ink versus a dilute suspension. The inks obtained with the process of the the present invention can be selected for a number of known imaging systems, such as xerographic imaging and printing processes, wherein latent images are rendered visible and which images possess excellent characteristics of image quality, solid area coverage and resolution.

Advantages, or problems solved with the processes of the present invention include the capability to consistently and uniformly achieve a liquid ink with a 50 or greater solids content without the potential for contamination by organic solvents used for extraction as, for example, is the situation with the processes as illustrated in U.S. Pat. No. 5,206,108 wherein hexane is used in combination with filtration or centrifugation to remove the aliphatic hydrocarbon vehicle in which the ink was generated. Alternative known means of liquid developer concentration include the use of a centrifuge, however, this operation is limited by the viscosity of the ink vehicle, the small particle size, and the similar densities of liquid and particle to typically less than about 30 percent solids. Various types of filter presses can achieve higher average solid concentrations, however, the inevitable nonuniformity of pressure applied throughout the filter cake results in a gradient of solids concentrations. Additionally, the compaction produced by a filter press may render the high solids ink more difficult to redisperse in the hydrocarbon vehicle for development in a printer.

Processes for the preparation of liquid inks by, for example, pressure filtration, or centrifugation are known. For example, U.S. Pat. No. 5,206,108 illustrates the use of hexane in combination with filtration or centrifugation to remove the aliphatic hydrocarbon vehicle in which the ink was generated, which process results in the contamination of the ink vehicle by organic solvents used for extraction. These contaminants possess a significant vapor pressure and are a health hazard that precludes their use in most environments. Alternative means of concentration include the use of a centrifuge, however, this operation is limited by the viscosity of the ink vehicle, the small ink particle size, and the similar densities of liquid and ink particle.

Various types of filter presses can achieve higher average solid concentrations, however, the nonuniformity of pressure applied throughout the filter cake results in a gradient of solids concentrations. Additionally, the compaction produced by a filter press may render the high solids ink more difficult to redisperse in the hydrocarbon vehicle for development in a copier or a printer.

Processes for the preparation of certain liquid electrostatic developers include mixing in a nonpolar liquid the thermoplastic resin, charging additive, and optional colorant and adjuvant in a manner that the resulting mixture contains, for example, from about 15 to about 30 percent by weight of solids; heating the mixture to a temperature of from about 70° C. to about 130° C. until a uniform dispersion is formed; adding an additional amount of nonpolar liquid sufficient to decrease the total solids concentration of the developer to about 10 to about 20 percent by weight; cooling the dispersion to about 10° C. to about 50° C.; adding the charge director compound to the dispersion; and diluting the dispersion.

In the initial mixture, the resin, colorant and charge adjuvant may be added separately to an appropriate vessel such as, for example, an attritor, heated ball mill, heated vibratory mill, such as a Sweco Mill manufactured by Sweco Company, Los Angeles, Calif., equipped with particulate media for dispersing and grinding, a Ross double planetary mixer manufactured by Charles Ross and Son, Hauppauge, N.Y., or a two roll heated mill, which usually requires no particulate media. Useful particulate media include materials like a spherical cylinder of stainless steel, carbon steel, alumina, ceramic, zirconia, silica and sillimanite. Carbon steel particulate media are particularly useful when colorants other than black are used. A typical diameter range for the particulate media is in the range of 0.04 to 0.5 inch (approximately 1.0 to approximately 13 millimeters). Other processes include extrusion, for example, U.S. Pat. No. 5,017,451 illustrates extrusion for melt mixing and a Microfluidizer® for particle size reduction. Also, in U.S. Pat. No. 5,387,489, the disclosure of which is totally incorporated herein by reference, there can be selected a piston homogenizer for particle size reduction.

When using an attritor, sufficient nonpolar liquid is added to provide a dispersion of from about 10 to about 50 percent solids. This mixture is then subjected to elevated temperatures during the initial mixing procedure to plasticize and soften the resin. The mixture is sufficiently heated to provide a uniform dispersion of all the solid materials of, for example, colorant, charge director, adjuvant and resin. However, the temperature at which this step is effected should not be high as to degrade the nonpolar liquid or decompose the resin or colorant if present. Accordingly, the mixture in embodiments is heated to a temperature of from about 70° C. to about 130° C., and preferably from about 75° C. to about 110° C. The mixture may be ground in a heated ball mill or heated attritor at this temperature for about 15 minutes to 5 hours, and preferably about 60 to about 180 minutes. After grinding at the above temperatures, an additional amount of nonpolar liquid may be added to the dispersion. The amount of nonpolar liquid to be added should be sufficient in embodiments to decrease the total solids concentration of the dispersion to about 10 to about 20 percent by weight.

The dispersion is then cooled to about 10° C. to about 50° C., and preferably to about 15° C. to about 30° C., while mixing is continued until the resin admixture solidifies or hardens. Upon cooling, the resin admixture precipitates out of the dispersant liquid. Cooling is accomplished by methods such as the use of a cooling fluid like water, glycols, such as ethylene gylcol, in a jacket surrounding the mixing vessel. Cooling is accomplished, for example, in the same vessel, such as an attritor, while simultaneously grinding with particulate media to prevent the formation of a gel or solid mass; without stirring to form a gel or solid mass, followed by shredding the gel or solid mass and grinding by means of particulate media; or with stirring to form a viscous mixture and grinding by means of particulate media. The resin precipitate is cold ground for about 1 to 36 hours, and preferably from about 2 to about 6 hours. Additional liquid may be added at any time during the preparation of the liquid developer to facilitate grinding or to dilute the developer to the appropriate percent solids needed for developing. Other processes of preparation are generally illustrated in U.S. Pat. Nos. 4,760,009; 5,017,451; 4,923,778; 4,783,389, the disclosures of which are totally incorporated herein by reference.

A latent electrostatic image can be developed with toner particles dispersed in an insulating nonpolar liquid. These dispersed materials are known as liquid toners or liquid developers. A latent electrostatic image may be generated by providing a photoconductive imaging member or layer with a uniform electrostatic charge, and subsequently discharging the electrostatic charge by exposing it to a modulated beam of radiant energy. Other methods are also known for forming latent electrostatic images such as, for example, providing a carrier with a dielectric surface and transferring a preformed electrostatic charge to the surface. After the latent image has been formed, the image is developed by colored toner particles dispersed in a nonpolar liquid. The image may then be transferred to a receiver sheet. Also known are ionographic imaging systems.

Typical liquid developers can comprise a thermoplastic resin and a dispersant nonpolar liquid. Generally, a suitable colorant, such as a dye or pigment, is also present in the developer. The colored toner particles, or solids are dispersed in a nonpolar liquid which generally has a high volume resistivity in excess of $10^9$ ohm-centimeters, a low dielectric constant, for example below 3.0, and a high vapor pressure. Generally, the toner particles are less than 30 $\mu$m (microns) average by area size as measured with the Malvern 3600E particle sizer.

The following patents relating to liquid developers and processes thereof are mentioned.

U.S. Pat. No. 5,030,535 discloses a liquid developer composition comprising a liquid vehicle, a charge control additive and toner pigmented particles. The toner particles may contain pigment particles and a resin selected from the group consisting of polyolefins, halogenated polyolefins and mixtures thereof. The liquid developers can be prepared by first dissolving the polymer resin in a liquid vehicle by heating at temperatures of from about 80° C. to about 120° C., adding pigment to the hot polymer solution and attriting the mixture; and then cooling the mixture whereby the polymer becomes insoluble in the liquid vehicle, thus forming an insoluble resin layer around the pigment particles.

Moreover, in U.S. Pat. No. 4,707,429 there are illustrated, for example, liquid developers with an aluminum stearate charge adjuvant. Liquid developers with charge directors are also illustrated in U.S. Pat. No. 5,045,425.

In copending patent application U.S. Ser. No. 986,316, now U.S. Pat. No. 5,998,081, the disclosure of which is totally incorporated herein by reference, there is illustrated a process for forming images which comprises (a) generating an electrostatic latent image; (b) contacting the latent image with a developer comprising a colorant and a substantial amount of a vehicle with a melting point of at least about 25° C., the developer having a melting point of at least about 25° C., wherein contacting occurs while the developer is maintained at a temperature at or above its melting point, the developer having a viscosity of no more than about 500 centipoise and a resistivity of no less than about $10^8$ ohm-cm at the temperature maintained while the developer is in contact with the latent image; and (c) cooling the developed image to a temperature below its melting point subsequent to development.

The disclosures of each of the copending patent applications and patents are totally incorporated herein by reference.

SUMMARY OF THE INVENTION

It is an object of the present invention to provide a liquid developer with many of the advantages illustrated herein.

Another object of the present invention resides in the provision of simple processes for the preparation of liquid developers.

It is a further object of the invention to provide processes for the preparation of liquid developers with high solids contents.

Also, it is a further object of the invention to provide supercritical fluid extraction processes for the preparation of liquid developers with high solids contents of, for example, about 50 percent or greater.

It is still a further object of the invention to provide supercritical processes for the preparation of liquid developers with solid contents of from about 50 to about 90 percent by weight.

Moreover, it is a further object of the invention to provide supercritical carbon dioxide solvent extraction processes for the preparation of liquid developers with high solids contents of, for example, about 50 percent or greater.

It is still a further object of the invention to provide processes for liquid developer wherein developed image defects, such as smearing, loss of resolution and loss of density, are eliminated or minimized.

Furthermore, in another object of the present invention there are provided liquid toners that enable excellent image characteristics, and which toners enhance the negative charge of resin, such a NUCREL®, based colored toners.

These and other objects of the present invention can be accomplished in embodiments by the provision of liquid developers and processes thereof. In embodiments, the present invention relates to processes for the preparation of liquid developers with high solids contents.

Embodiments of the present invention comprise a process for the preparation of a liquid developer comprised of thermoplastic resin particles, pigment, a charge additive or adjuvant and a charge director, which process comprises a supercritical solvent extraction to enable a developer with a high solids content; a process for the preparation of a liquid developer comprised of thermoplastic resin particles, pigment, a charge additive or adjuvant and a charge director, which process comprises the supercritical carbon dioxide solvent extraction of the liquid vehicle of the developer to enable a developer with a high solids content of from about 50 to about 90 weight percent, and wherein the solids are comprised of resin, pigment, and charge adjuvant; a process wherein the supercritical carbon dioxide solvent extraction comprises supplying a developer suspension to the extraction vessel, which suspension can be in the form of liquid, paste, or granular solid, and which suspension contains a hydrocarbon dispersant to be removed in part or in entirety;

supplying to the extraction vessel a supercritical solvent for the hydrocarbon dispersant; removing the supercritical solvent into which the hydrocarbon dispersant has dissolved from the extraction vessel; lowering the pressure of the solution to vaporize the solvent; and recovering the concentrated liquid developer.

DESCRIPTION OF THE FIGURE

Illustrated in FIG. 1 is a process embodiment of the present invention.

The process of the present invention in embodiments relates to the preparation of liquid inks with a solids content of from about 50 to about 90, and preferably from about 50 to about 75 weight percent by supercritical fluid extraction, and wherein the solids are comprised of resin, charge adjuvant and pigment, or dye. More specifically, the process of the present invention utilizes an extraction system with the following general components, reference FIG. 1, a pump capable of pumping carbon dioxide up to about 4,000 to 5,000 psi, an extraction vessel able to withstand these pressures, capable of being heated, and able to contain the ink to be processed, and a device for releasing the pressure while maintaining back pressure on the system.

In FIG. 1 the components thereof are as follows:

| | |
|---|---|
| 1. | Liquid $CO_2$ Supply |
| 2. | Shut-Off Valve |
| 3 | Cooling Bath (Neslab RTE-110) |
| 4. | Pump |
| 5. | Regulating Valve (Haskel pn 53379-4) |
| 6. | Pressure Gauge |
| 7A. | Shut-off Valve |
| 7B. | Shut-off Valve |
| 8. | Gear Pump (Micropump pn L3362093) |
| 9. | Extraction Vessel (75 ml) |
| 10. | Regulating Valve (Haskel pn 53379-4) |
| 11. | Needle Valve (AE pn 30VRMM481 2-PM |
| 12. | Separator Vessel |
| 13. | Relief Valve |
| 14. | Coalescing Filter (Balston A944-DX) |
| 15. | Coalescing Filter (Balston A94-BX) |
| 16. | Carbon Filter (Balston pn DAU-000) |
| 17. | Flow Meter (F & P pn 10A35551375-Z) |
| 18. | Pressure Gauge |
| 19. | Shut-off Valve |
| 20. | 64 $\mu$ Filter |
| 21. | Sight Gauge |
| 22A. | Valve |
| 22B. | Valve |
| 23. | Totalizer (Singer pn DTM-115-1) |

With further reference to FIG. 1, the process of the present invention in embodiments is initiated with the carbon dioxide source 1 and a pump. A liquid $CO_2$ source that was chilled in bath 3 was utilized, and the coolant from this bath was also used to cool the pump head of a LDC minipump Model 396. The bath coolant was maintained typically at −10 to −20° C. The pump employed was a reciprocating piston arrangement that was cooled to avoid vaporization of the $CO_2$ and subsequent cavitation and loss of pumping ability. More sophisticated pumps may also be used such as compressors which do not require the $CO_2$ to be liquid. Syringe pumps can also be used in the supercritical fluid process of the present invention. Subsequent to pumping, the fluid pressure is controlled by a pressure regulator 5 and monitored by gauge 6. The fluid is then directed to extraction vessel 9 which is heated by electric band heaters and the temperature monitored by means of a thermocouple. This vessel is equipped with sintered metal screens at either end to retain the solid toner particles while allowing the fluid phase to pass. The direction of flow to the extraction vessel can be varied by means of valves 7A, 7B, 22A, 22B and gear pump 8. For instance, by closing valves 7A and 22A, and opening valves 7B and 22B flow is directed upwards through the vessel. Similarly, by closing valves 7B and 22B, and opening valves 7A and 22A flow is directed downward through the vessel. Opening valves 7A, 7B, and one of 22A or B, with the other closed, and with pump 8 operating the carbon dioxide fluid can be recirculated continuously through vessel 9, which vessel contains the liquid suspension of resin, colorant and charge adjuvant in a hydrocarbon dispersant with extract laden supercritical fluid removed via the open valve 22. The extraction vessel may be of different geometries and sizes, and this vessel may also be stirred. An example of such a vessel is a 300 milliliter vessel obtained from Autoclave Engineering of Erie, Pa. A sight gauge is provided to monitor the condition of the fluid in the system; this gauge may be heated with circulating hot oil. After passing through one of the valves 22, the fluid passes through an in-line filter 20 to protect downstream components. The post extraction pressure is monitored by pressure gauge 18 before passing pressure regulating valve 10 and needle valve 11. Both these valves, and the connecting line in between are heated by electric heating tape. This heating compensates for the cooling effect of the expansion of carbon dioxide through these valves; the precise temperature is not critical providing it is sufficient to prevent the lines and valves from freezing the hydrocarbon or $CO_2$; and the temperature will fluctuate with the rate of $CO_2$ flow. In embodiments, the current to the heaters is adjusted to retain these components warm to the touch, about 50 to 60° C. Valve 10 provides most of the control over back pressure and partial control over flow; and valve 11 provides some control over flow to prevent exceeding the capacity of the downstream components. Alternatively, a single needle valve or small orifice of about 2 to 40 mils may be used to relieve the pressure, especially when large pumping capacity for the $CO_2$ is used. Adjusting valves 5 and 10 provide the pressure control for the system. The extracted ink hydrocarbon precipitates from the carbon dioxide as the pressure drops and is swept into separator vessel 12 where it can be collected via valve 19. A small amount, such as for example 1 or 2 milliliters, of hydrocarbon is removed by filters 14 to 16. The $CO_2$ flow is monitored by flow meter 17 and totalizer 23. There remains in 9 the desired liquid ink with increased solids of, for example, 50 percent of resin, pigment and charge adjuvant with a decreased amount of hydrocarbon fluid like NORPAR®. Thus, the solids content was increased from 10 percent to 50 percent. The ink is then removed by detaching the 9 end fittings and tapping tube 9.

A number of process operating conditions are feasible with a variety of hydrocarbons such as the ISOPAR® series liquids, the NORPAR® series both available from Exxon Corporation, the SOLTROL® series available from the Phillips Petroleum Company, the SHELLSOL® series available from the Shell Oil Company or the SUPERLA White Mineral Oils available from Amoco. Solubility of 2 to 3 percent for a NUJOL mineral oil to above 50 percent for NORPAR 15® is achieved with pressures above 2,000 psi. Significant solubility occurs with some hydrocarbons, such as NORPAR 15® as low as 1,200 psi. These estimates of solubility where obtained with the apparatus of FIG. 1, and more specifically by recirculating the hydrocarbon/$CO_2$ mixture through sight gauge 21 by means of gear pump 8 a single clear phase was interpreted as miscibility at a given ratio of components. Far more rigorous analysis of hydrocarbon carbon dioxide phase behavior exists in the literature, for example see Fall et al. in *J. Chem. Eng.* Data, 30, 82, 1985, the disclosure of which is totally incorporated herein by reference. The density of the supercritical fluid and its solvating power increases with pressure, but beyond 4,000 psi little more can be gained practically. The temperature range in the extraction vessel is typically about 35° C., since below 31° C. carbon dioxide becomes subcritical the possibility of another phase (liquid) forming can render process control more difficult. Solvating power increases with temperature, but at some temperature the toner will agglomerate; the temperature at which this occurs is likely about 70° C. so the operating temperature should be kept below this value.

The starting material can be any suitable hydrocarbon dispersed toner. It may be in a liquid form, such as found at about 2 to about 15 or 20 percent solids; it may be a paste like concentration of about 20 to 40 percent solids; or a powder such as found at concentrations above about 40 weight percent. Liquid suspensions offer the advantage of being simple to load into the extraction vessel, but require larger vessels relative to the output obtained. Since pressure vessels can be costly, one embodiment isto concentrate a liquid toner, for example 10 percent solids, which is a common product of the attritor process, to a paste like consistency comprised of from about 20 to about 25 percent of solids before extracting to higher solids of greater than 30 percent and up to 100 percent loading thereby reducing the required size of the pressure vessel by 100 to 150 percent.

The starting material may be further extracted to any desired concentration beyond what is readily achieved by centrifugation, from about 30 weight percent solids to about 100 weight percent solids. The desired concentration is generally determined by the needs of the printing engine and not the process of this invention. The solids content may be determined by thermogravimetric analysis, either by drying and weighing large dishes of sample by hand using heat lamps or oven, or by using known TGA instruments.

Embodiments of the present invention include supercritical processes for the preparation of liquid developers comprised of thermoplastic resin particles; a charge director; charge additives; a liquid developer comprised of a liquid component, thermoplastic resin and pigment; an ionic or zwitterionic charge director or directors soluble in a nonpolar liquid; charge additives; and a liquid electrostatographic developer comprised of (A) a liquid having viscosity of from about 0.5 to about 20 centipoise and resistivity equal to and preferably greater than $5\times10^9$; (B) thermoplastic resin particles with an average volume particle diameter of from about 0.1 to about 30 microns, and preferably from 1 to about 12 microns; (C) a nonpolar liquid soluble ionic or zwitterionic charge director compound; and (D) charge additive. Embodiments of the present invention include a process for the preparation of a liquid developer wherein the aliphatic hydrocarbon contains a mixture of branched hydrocarbons of from about 12 to about 16 carbon atoms, or a mixture of normal hydrocarbons of from about 10 to about 16 carbon atoms; a process for the preparation of a liquid developer wherein the aliphatic hydrocarbon is comprised of a mixture of branched hydrocarbons of from about 12 to about 16 carbon atoms; and a process for the preparation of a liquid developer wherein the carbon dioxide is at a temperature of above 31° C. and at a pressure of about 1,070 to 3,500 pounds per square inch. The charge director may or may not be added to the liquid developer during the above process, however, the hydrocarbon and all the components of the toner particle of resin, pigment, and charge adjuvant are present.

Moreover, in embodiments of the present invention there are provided supercritical processes for the preparation of liquid developers as indicated herein, wherein the solids content of the liquid developer can be increased from about 20 weight percent to about 55 weight percent prior to the supercritical process. Also, in embodiments the pressure selected for the supercritical carbon dioxide solvent extraction is from about 1,100 to about 5,000 pounds per square inch, and the temperature selected for the supercritical carbon dioxide solvent extraction is from about 30 to about 70° C. The pigment of the liquid developer can be present in amounts of, for example, from about 5 to about 60 percent by weight based on the total weight of the developer solids. The aforementioned pigment is as illustrated herein and can include carbon black, cyan, magenta, yellow, red, green, blue, brown, or mixtures thereof. Moreover, the carbon dioxide selected for the process of the present invention in embodiments can be at a pressure of from about 1,070 to 3,500 pounds per square inch, and the temperature thereof can be above 31° C.

Examples of liquid carriers or components that can be selected and extracted include a liquid with an effective viscosity of, for example, from about 0.5 to about 500 centipoise, and preferably from about 1 to about 20 centipoise, and a resistivity equal to or greater than $5\times10^9$ ohm/centimeter, such as $5\times10^{13}$. Preferably, the liquid selected is a branched chain aliphatic hydrocarbon. A nonpolar liquid of the ISOPAR® series (manufactured by the Exxon Corporation) may also be utilized. These hydrocarbon liquids are considered narrow portions of isoparaffinic hydrocarbon fractions with extremely high levels of purity. The liquids selected are generally known and should have an electrical volume resistivity in excess of $10^9$ ohm-centimeters and a dielectric constant below 3.0 in embodiments of the present invention. Moreover, the equilibrium vapor pressure at 25° C. should preferably be less than 10 Torr in embodiments.

While the ISOPAR® series liquids may be the preferred nonpolar liquids for use as dispersants in the liquid developers, the essential characteristics of viscosity and resistivity may be achieved with other suitable liquids. Specifically, the NORPAR® series available from Exxon Corporation, the SOLTROL® series available from the Phillips Petroleum Company, and the SHELLSOL® series available from the Shell Oil Company can be selected. SUPERLA™ White Mineral Oil No. 5 available from Amoco can also be selected.

The amount of the liquid employed in the developer housing of the printing machine is preferably from about 95 to about 99 percent by weight of the total developer dispersion, however, other effective amounts may be selected. The total solids content of the developer when employed in a printing engine in embodiments is, for example, 0.1 to 10 percent by weight, preferably 0.3 to 3 percent, and more preferably 0.5 to 2.0 percent by weight. However, the large excess of liquid is a disadvantage to the operator and often the toner is supplied in a more concentrated form to minimize this problem. The concentrated ink may be diluted on site or in the machine to the working concentration. One approach taken to minimize the build of excess hydrocarbon, which must be disposed of, is maintain a mass balance of liquid and solid components of the developer during operation. The solid images formed on paper by liquid immersion development can range in solid content from about 30 weight percent to about 100 weight percent depending on the design of the machine and the type of liquid recovery systems employed in the development step and subsequent image conditioning steps often referred to as blotting. The recovered liquid can be cleaned of any contaminants and returned for reuse as a diluent of concentrated toner in the development housing. By matching the solids concentration of the toner concentrate with that of the final image build up of excess liquid can be avoided. This invention is directed toward concentrating liquid developers to the required concentration.

Typical suitable thermoplastic toner resins can be selected for the liquid developers of the present invention in effective amounts, for example in the range of about 99 percent to about 40 percent, and preferably 95 percent to 70 percent of developer solids comprised of thermoplastic resin, pigment, charge additive, and in embodiments other components that may comprise the toner. Generally, developer solids include the thermoplastic resin, optional pigment and charge control agent. Examples of resins include ethylene vinyl acetate (EVA) copolymers (ELVAX® resins, E. I. DuPont de Nemours and Company, Wilmington, Del.); copolymers of ethylene and an α-β-ethylenically unsaturated acid selected from the group consisting of acrylic acid and methacrylic acid; copolymers of ethylene (80 to 99.9 percent), acrylic or methacrylic acid (20 to 0.1 percent)/alkyl ($C_1$ to $C_5$) ester of methacrylic or acrylic acid (0.1 to 20 percent); polyethylene; polystyrene; isotactic polypropylene (crystalline); ethylene ethyl acrylate series available as BAKELITE® DPD 6169, DPDA 6182 NATURAL™ (Union Carbide Corporation, Stamford, Conn.); ethylene vinyl acetate resins like DQDA 6832 Natural 7 (Union Carbide Corporation); SURLYN® ionomer resin (E. I. DuPont de Nemours and Company), or blends thereof; polyesters; polyvinyl toluene; polyamides; styrene/butadiene copolymers; epoxy resins; acrylic resins, such as a copolymer of acrylic or methacrylic acid, and at least one alkyl ester of acrylic or methacrylic acid wherein alkyl is 1 to 20 carbon atoms, such as methyl methacrylate (50 to 90 percent)/methacrylic acid (0 to 20 percent)/ethylhexyl acrylate (10 to 50 percent); other acrylic resins including ELVACITE® acrylic resins (E. I. DuPont de Nemours and Company); or blends thereof. Preferred copolymers in embodiments include the copolymers of ethylene and an α-β-ethylenically unsaturated acid of either acrylic acid or methacrylic acid. In preferred embodiments, NUCREL® resins available from E. I. DuPont de Nemours and Company like NUCREL® 599, NUCREL® 699, or NUCREL® 960 are selected as the thermoplastic resin.

The liquid developers may optionally contain, and preferably does contain in embodiments a colorant dispersed in the resin particles. Colorants, such as pigments or dyes and mixtures thereof, are preferably present to render the latent image visible.

The colorant may be present in the toner in an effective amount of, for example, from about 0.1 to about 60 percent, and preferably from about 1 to about 30, and in embodiments 10 percent by weight based on the total weight of solids contained in the developer. The amount of colorant used may vary depending on the use of the developer. Examples of pigments which may be selected include carbon blacks available from, for example, Cabot Corporation, FANAL PINK™, PV FAST BLUE™, those pigments as illustrated in U.S. Pat. No. 5,223,368, the disclosure of which is totally incorporated herein by reference, and other known pigments. Examples of specific pigments include the following.

| PIGMENT BRAND NAME | MANU-FACTURER | COLOR |
|---|---|---|
| Permanent Yellow DHG | Hoechst | Yellow 12 |
| Permanent Yellow GR | Hoechst | Yellow 13 |
| Permanent Yellow G | Hoechst | Yellow 14 |
| Permanent Yellow NCG-71 | Hoechst | Yellow 16 |
| Permanent Yellow GG | Hoechst | Yellow 17 |
| L74-1357 Yellow | Sun Chemical | Yellow 14 |
| L75-1331 Yellow | Sun Chemical | Yellow 17 |
| Hansa Yellow RA | Hoechst | Yellow 73 |
| Hansa Brilliant Yellow 5GX-02 | Hoechst | Yellow 74 |
| DALAMAR ® YELLOW YT-858-D | Heubach | Yellow 74 |
| Hansa Yellow X | Hoechst | Yellow 75 |
| NOVAPERM ® YELLOW HR | Hoechst | Yellow 83 |
| L75-2337 Yellow | Sun Chemical | Yellow 83 |
| CROMOPHTHAL ® YELLOW 3G | Ciba-Geigy | Yellow 93 |
| CROMOPHTHAL ® YELLOW GR | Ciba-Geigy | Yellow 95 |
| NOVAPERM ® YELLOW FGL | Hoechst | Yellow 97 |
| Hansa Brilliant Yellow 10GX | Hoechst | Yellow 98 |
| LUMOGEN ® LIGHT YELLOW | BASF | Yellow 110 |
| Permanent Yellow G3R-01 | Hoechst | Yellow 114 |
| CROMOPHTHAL ® YELLOW 8G | Ciba-Geigy | Yellow 128 |
| IRGAZINE ® YELLOW 5GT | Ciba-Geigy | Yellow 129 |
| HOSTAPERM ® YELLOW H4G | Hoechst | Yellow 151 |
| HOSTAPERM ® YELLOW H3G | Hoechst | Yellow 154 |
| HOSTAPERM ® ORANGE GR | Hoechst | Orange 43 |
| PALIOGEN ® ORANGE | BASF | Orange 51 |
| IRGALITE ® RUBINE 4BL | Ciba-Geigy | Red 57:1 |
| QUINDO ® MAGENTA | Mobay | Red 122 |
| INDOFAST ® BRILLIANT SCARLET | Mobay | Red 123 |
| HOSTAPERM ® SCARLET GO | Hoechst | Red 168 |
| Permanent Rubine F6B | Hoechst | Red 184 |
| MONASTRAL ® MAGENTA | Ciba-Geigy | Red 202 |
| MONASTRAL ® SCARLET | Ciba-Geigy | Red 207 |
| HELIOGEN ® BLUE L 6901F | BASF | Blue 15:2 |
| HELIOGEN ® BLUE TBD 7010 | BASF | Blue:3 |
| HELIOGEN ® BLUE K 7090 | BASF | Blue 15:3 |
| HELIOGEN ® BLUE L 7101F | BASF | Blue 15:4 |
| HELIOGEN ® BLUE L 6470 | BASF | Blue 60 |
| HELIOGEN ® GREEN K 8683 | BASF | Green 7 |
| HELIOGEN ® GREEN L 9140 | BASF | Green 36 |
| MONASTRAL ® VIOLET | Ciba-Geigy | Violet 19 |
| MONASTRAL ® RED | Ciba-Geigy | Violet 19 |
| QUINDO ® RED 6700 | Mobay | Violet 19 |
| QUINDO ® RED 6713 | Mobay | Violet 19 |
| INDOFAST ® VIOLET | Mobay | Violet 19 |
| MONASTRAL ® VIOLET Maroon B | Ciba-Geigy | Violet 42 |
| STERLING ® NS BLACK | Cabot | Black 7 |
| STERLING ® NSX 76 | Cabot | |
| TIPURE ® R-101 | DuPont | White 6 |
| MOGUL ® L | Cabot | Black, Cl 77266 |
| UHLICH ® BK 8200 | Paul Uhlich | Black |

Suitable nonpolar liquid soluble ionic or zwitterionic charge director compounds, which are selected in various effective amounts, such as for example from about 0.25 to about 1,500 milligrams/gram, and preferably 2.5 to 400 milligrams/gram based on the amount of developer solids comprised of resin, pigment, and charge adjuvant, include anionic glyceride, such as EMPHOS D70-30™ and EMPHOS F27-85™, two products available from Witco Corporation, New York, N.Y., which are sodium salts of phosphated mono and diglycerides with unsaturated and saturated acid substituents, respectively, lecithin, BASIC BARIUM PETRONATE®, NEUTRAL BARIUM PETRONATE®, CALCIUM PETRONATE®, NEUTRAL CALCIUM PETRONATE®, oil soluble petroleum sulfonates, Witco Corporation, New York, N.Y.; and metallic soaps such as barium, calcium, lead, and zinc stearates; cobalt, manganese, lead, and zinc linoleates; calcium and cobalt octoates; quaternary ammonium block copolymers as illustrated, for example, in U.S. Pat. No. 5,035,972, the disclosure of which is totally incorporated herein by reference; other known charge directors; and the like.

To increase the toner particle charge and, accordingly, increase the mobility and transfer latitude of the toner particles, charge adjuvants can be added to the toner particles. For example, adjuvants, such as metallic soaps like aluminum or magnesium stearate or octoate, fine particle size oxides, such as oxides of silica, alumina, titania, and the like, paratoluene sulfonic acid, and polyphosphoric acid, may be added. Negative charge adjuvants increase the negative charge of the toner particles, while the positive charge adjuvants increase the positive charge of the toner particles. With the invention of the present application, these types of adjuvants can assist in enabling improved toner charging characteristics, namely, an increase in particle charge that results in improved electrophoretic mobility for improved image development and transfer to allow superior image quality with improved solid area coverage and resolution in embodiments. The adjuvants can be added to the toner particles in an amount of from about 0.1 percent to about 15 percent of the total developer solids and preferably from about 1 percent to about 5 percent of the total weight of solids contained in the developer.

As illustrated herein, the developers or inks obtained with the processes of present invention can be selected for imaging and printing methods wherein, for example, a latent image is formed on a photoconductive imaging member, reference for example selenium, selenium alloys, those of U.S. Pat. No. 4,265,990, the disclosure of which is totally incorporated herein by reference, and the like; followed by development with the toner of the present invention by, for example, immersion of the imaging member in the liquid toner; transfer to a suitable substrate like paper; and fixing by heating.

Embodiments of the invention will be illustrated in the following nonlimiting Examples, it being understood that these Examples are intended to be illustrative only, and that the invention is not intended to be limited to the materials, conditions, process parameters and the like recited.

EXAMPLE I

One hundred and seventy-five (175.0) grams of NUCREL 599® (a copolymer of ethylene and methacrylic acid with a melt index at 190° C. of 500, available from E. I. DuPont de Nemours & Company, Wilmington, Del.), 45.4 grams of the cyan pigment (PV FAST BLUE™), and 370.4 grams of NORPAR 15® (Exxon Corporation) were added to a Union Process O1 attritor (Union Process Company, Akron, Ohio) charged with 0.1857 inch (4.76 millimeters) diameter carbon steel balls. The mixture was milled in the attritor, which was heated with running steam through the attritor jacket at 55 to 106° C. for 2 hours, and 980.1 gram of additional NORPAR® was added; the attritor was cooled by running water through the attritor jacket to ambient temperature; and the mixture was ground in the attritor for an additional 4 hours. Additional NORPAR 15®, about 1,400 to 1,600 grams, was added and the mixture was separated from the steel balls. The percent solids was measured by heating about 20 grams of the suspension of toner of the above composition in NORPAR® 15 under heat lamps, and after 24 to 48 hours of heating or until there was no further weight loss due to NORPAR® evaporation the residual solid constituted about 7.4 percent by weight of the original suspension. The solid constituents were NUCREL 599®, and PV FAST BLUE™ pigment. Similar measurements using a TA 2950 High Resolution TGA provided a percent solids level of 7.1.

EXAMPLE II

Sixty (60.0) milliliters of the developer of Example I were placed in extraction vessel 9 of the apparatus of FIG. 1. This was extracted for about 7.5 hours during which time 39.1 milliliters of liquid were collected in the separator vessel 12. The system pressure was maintained between 2,000 and 3,000 psi during the extraction and the temperature in the extraction vessel between 33 to 35° C. The total flow of $CO_2$ was measured as a gas at room temperature and pressure by the totalizer (23) as 17.3 cubic feet or about 0.89 killigram of carbon dioxide. The extraction was interrupted once to clean the filter 20 and to place a backing o-ring behind the 2 micron sintered metal filter disc at the top of the extraction vessel 9. The gear pump 8 was run for the first two hours of the extraction. The extracted material was removed from the extraction vessel, and it was noted that the upper portion of the sample was dark blue in color while the remainder was light blue. TGA analysis showed that the dark blue material was 32 percent toner solids of NUCREL 599® resin and PV FAST BLUE™ pigment, and the light blue was 94 percent toner solids of NUCREL 599® resin and PV FAST BLUE™ pigment.

EXAMPLE III

Two hundred and ten point nine (210.9) grams of the developer of Example I were centrifuged at 3,000 RPM for 20 minutes in a Baxter CRYROFUGE 6000 centrifuge. After decanting the supernatant, the remaining paste in the bottom of the centrifuge bottle was analyzed by TGA and found to be 23.5 weight percent toner solids comprised of NUCREL 599® resin and PV FAST BLUE™ pigmnent. 30.7 Grams of the resulting centrifuged developer were placed in the extraction vessel 9 in essentially the same apparatus of FIG. 1. The apparatus of this Example differs from the previous Example II in that the pressure release is accomplished solely by the needle valve 11 and there is no sight gauge, gear pump, or in-line filter for the supercritical phase. During the course of the extraction, valves 7A and 7B were alternately closed and opened every 15 minutes so that the flow through the extraction vessel alternated between upward and downward. The centrifuged developer was extracted for about 170 minutes during which time 18.8 grams of liquid were collected in the separator vessel 12. The system pressure was maintained between 2,000 and 5,000 psi during the extraction and the temperature in the extraction vessel was between 36 to 40° C. The total flow of $CO_2$ was measured as a gas at room temperature and pressure by the totalizer 23 as 22.2 cubic feet or about 1.14 killigrams of carbon dioxide. The extracted material was removed from the extraction vessel, and it was noted that the middle portion of the sample was darker blue than either the upper or lower portions. TGA analysis showed that samples taken from the upper, middle and lower portion of the vessel were 88 percent, 42 percent and 89 percent toner solids of NUCREL 599® resin and PV FAST BLUE™ pigment, respectively.

EXAMPLE IV

The process of Example II was repeated with the replacement of the narrow pipe extractor 9 of FIG. 1 with a stirred autoclave of about 300 ml internal volume available from Autoclave Engineers Group of Erie, Pa. This vessel was rated to over 6,000 psi pressure. The stirring was accomplished by a helical stirrer coupled to a 1/20 hp variable speed electric motor via a magnetic coupling. To such a vessel about 200 milliliters of the developer or liquid ink of Example I were added. The extraction vessel was maintained at about 35 to 40° C. and extracted with about 40 cubic foot or about 2 killigrams of carbon dioxide while stirring slowly to maintain a uniform solids composition. The extent of extraction was monitored by collecting liquid from the separator vessel 12 and by visually monitoring the extraction vessel via high pressure windows.

EXAMPLE V

The process of Example III was repeated with the replacement of the narrow pipe extractor 9 of FIG. 1 with a stirred autoclave of about 300 milliliters internal volume available from Autoclave Engineers Group, of Erie, Pa. This vessel was rated to over 6,000 psi pressure. The stirring was accomplished by a helical stirrer coupled to a 1/20 hp variable speed electric motor via a magnetic coupling. To such a vessel, about 100 grams of the centrifuged developer of Example III were added. The extraction vessel was maintained at about 35 to 40° C. and extracted with about 40 cubic foot or about 2 killigrams of carbon dioxide while stirring slowly to maintain a uniform solids composition. The extent of extraction can be monitored by collecting liquid from the separator vessel 12 and by visually monitoring the extraction vessel via high pressure windows.

EXAMPLE VI

An Autoclave Engineering Supercritical extraction unit was employed for a process embodiment wherein the ink was comprised of a 50/50 blend of NORPAR® and NUCREL 599™ prepared by mixing the two components together at 100° C. until a single phase formed, and then cooling. This test blend was subjected to a variety of supercritical conditions in a closed system, that is, there was no active extraction occurring. At the end of the experiment, when the pressure was about 2,000 psi and the temperature was 25° C., the pressure was rapidly released and it was noticed that the expelled gas contained a mist or aerosol of a liquid believed to be NORPAR®. TGA analysis of the starting material showed a NORPAR® content of about 53 percent, and after the supercritical treatment this level dropped to about 21.5 percent. This treatment thus changed the material from 47 percent solids to 78.5 percent toner solids of NUCREL 599® resin and PV FAST BLUE™ pigment.

EXAMPLE VII

Using the same extraction system of Example VI, an active extraction was accomplished on a sample of a 65/35 blend of NORPAR® and NUCREL 599® prepared by mixing the two components together at 100° C. until a single phase formed, and then cooling. TGA provided the percent solids of the starting material as 34.9 percent toner solids of NUCREL 599® resin and PV FAST BLUE™ pigment. Approximately 24 grams of this material were placed in the extraction vessel, and the system sealed and pressurized to about 2,000 psi, and the extraction vessel, reference FIG. 1, heated to about 45° C. The extraction took place over the course of 40 minutes during which time the temperature decreased to 38° C. and the pressure to about 1,600 psi. The total flow of carbon dioxide was about 1.5 cubic feet (as a gas at room temperature). At the end of 40 minutes the pressure was released and about 10 milliliters of NORPAR® were recovered from the separator vessel. The toner solids consisting of NUCREL 599® resin and PV FAST BLUE™ pigment content of the mixture increased from 34.9 weight percent to 72.9 weight percent.

In place of the $CO_2$, there can be utilized, it is believed, in embodiments components such as ethane, ethylene, chlorotrifluoromethane, and the like.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the preparation of a liquid developer consisting essentially of a hydrocarbon liquid vehicle, thermoplastic resin particles, pigment, a charge additive or adjuvant, and a charge director, which process consists essentially of a supercritical solvent extraction of said liquid vehicle and wherein said liquid developer possesses a high solids content.

2. A process for the preparation of a liquid developer consisting essentially of a liquid vehicle, thermoplastic resin particles, pigment, a charge adjuvant and a charge director, which process consists essentially of the supercritical carbon dioxide solvent extraction of said liquid vehicle of said developer and wherein said liquid developer possesses a high solids content of from about 50 to about 90 weight percent, and wherein the solids are comprised of thermoplastic resin particles, pigment, and charge adjuvant.

3. A process in accordance with claim 2 wherein the supercritical carbon dioxide solvent extraction is accomplished at a pressure of from about 1,100 to about 5,000 pounds per square inch and at a temperature of from about 30° C. to about 70° C.

4. A process in accordance with claim 2 wherein there is extracted from the liquid vehicle of said developer a linear or branched hydrocarbon.

5. A process in accordance with claim 2 wherein the resin particles are comprised of a copolymer of ethylene and acrylic acid or a copolymer of ethylene and methacrylic acid.

6. A process in accordance with claim 5 wherein the liquid vehicle is an aliphatic hydrocarbon.

7. A process in accordance with claim 6 wherein the aliphatic hydrocarbon is a mixture of branched hydrocarbons of from about 12 to about 16 carbon atoms.

8. A process in accordance with claim 2 wherein the pigment is present in an amount of from about 5 to about 60 percent by weight based on the total weight of the developer solids.

9. A process in accordance with claim 2 wherein the pigment is carbon black, cyan, magenta, yellow, red, green, blue, brown, or mixtures thereof.

10. A process in accordance with claim 2 wherein the liquid vehicle for said developer is an aliphatic hydrocarbon.

11. A process in accordance with claim 10 wherein the aliphatic hydrocarbon is a mixture of branched hydrocarbons of from about 12 to about 16 carbon atoms, or a mixture of normal hydrocarbons of from about 10 to about 16 carbon atoms.

12. A process in accordance with claim 2 wherein the carbon dioxide is at a temperature of above 31° C. and a pressure of about 1,070 to 3,500 pounds per square inch.

13. A process in accordance with claim 2 wherein the solids content of the formed developer is at least 50 weight percent, and the liquid is an aliphatic hydrocarbon, and which aliphatic hydrocarbon is extracted under supercritical carbon dioxide conditions.

14. A process in accordance with claim 2 wherein the pigment is carbon black.

15. A process in accordance with claim 2 wherein the pigment is cyan, magenta, yellow, or mixtures thereof.

16. A process in accordance with claim 15 wherein the supercritical carbon dioxide solvent extraction is accomplished at a pressure of from about 1,100 to about 5,000 pounds per square inch.

17. A process in accordance with claim 16 wherein said supercritical carbon dioxide solvent extraction is accomplished at a temperature of from about 30 to about 70° C.

18. A process for the preparation of a liquid developer comprised of a hydrocarbon liquid vehicle, thermoplastic resin particles, pigment, and a charge adjuvant, and which process consists essentially of accomplishing a super critical carbon dioxide solvent extraction of said liquid vehicle from said developer, and wherein said liquid developer possesses a high solids content of from about 30 to about 100 weight percent, and wherein said solids are comprised of thermoplastic resin particles, pigment particles, and charge adjuvant.

19. A process in accordance with claim 18 wherein the said solids content is from about 50 to about 90 weight percent.

* * * * *